United States Patent [19]

Hedderick et al.

[11] Patent Number: 5,062,548

[45] Date of Patent: Nov. 5, 1991

[54] BEVERAGE DISPENSING SYSTEM

[75] Inventors: John B. Hedderick, Pinner; Brian R. Rutty, Weybridge; David G. Page, Swindon; John J. Walshe, Minety, all of Great Britain

[73] Assignee: Arthur Guinness Son and Company (Great Britian) Limited, London, Great Britain

[21] Appl. No.: 649,112

[22] Filed: Jan. 28, 1991

Related U.S. Application Data

[63] Continuation of Ser. No. 314,235, Feb. 21, 1989, abandoned, which is a continuation of Ser. No. 120,230, Nov. 10, 1987, abandoned, which is a continuation of Ser. No. 838,625, Mar. 11, 1986, abandoned.

[30] Foreign Application Priority Data

Mar. 11, 1985 [GB] United Kingdom ..... 8506227

[51] Int. Cl.[5] ..... B67D 5/58

[52] U.S. Cl. ..... 222/190; 239/412; 239/432; 239/211; 137/170.1; 261/DIG. 7; 261/64.2; 261/28; 261/123

[58] Field of Search ..... 222/96, 105, 135, 145, 222/129.1, 129.2, 190; 239/343, 412, 432, 211; 137/170.1, 170.4, 170.5; 261/DIG. 7, 64.2, 28, 123

[56] References Cited

U.S. PATENT DOCUMENTS

| | | | |
|---|---|---|---|
| 1,984,617 | 12/1934 | Williams | 261/DIG. 7 |
| 2,088,089 | 7/1937 | McDonald | 261/DIG. 7 |
| 3,042,311 | 7/1962 | Edwards et al. | 239/412 |
| 3,361,161 | 1/1968 | Schwartz | 222/145 |
| 3,618,856 | 11/1971 | Sachnik | 239/343 |
| 3,640,433 | 2/1972 | Rodth | 222/129.2 |
| 3,761,066 | 9/1973 | Wheeler | 261/DIG. 7 |
| 4,356,937 | 11/1982 | Simon et al. | 222/129.2 |

FOREIGN PATENT DOCUMENTS 1063753 3/1967 United Kingdom .

*Primary Examiner*—H. Grant Skaggs

[57] ABSTRACT

A beverage dispensing system has a valve in a tap controlling dispensing of the beverage through a first passage from a second rigid or flexible container. Air, nitrogen (or other inert gas) or carbon dioxide gas from a passage is introduced into the beverage in the first passage during dispensing for development of a head of froth. The introduced gas flows under pressure (which is preferably adjustable) from the second passage and by way of a capilliary tube restrictor and a non return valve communicating with the tube into the beverage in the first passage. The non return valve has a resilient diaphragm which normally closes that valve and is displaceable under gas pressure to admit the gas to the beverage. A labyrinthine mixer is located in the first passage downstream of the position where the gas is introduced.

19 Claims, 4 Drawing Sheets

BEVERAGE DISPENSING SYSTEM

This application is a continuation of Ser. No. 314,235, filed on Feb. 21, 1989, in turn a continuation of Ser. No. 120,230, filed on Nov. 10, 1987, in turn a continuation of Ser. No. 838,625, filed on Mar. 11, 1986 all now abandoned.

TECHNICAL FIELD AND BACKGROUND ART

This invention relates to a beverage dispensing system and is particularly concerned with such a system wherein a gas selected from carbon dioxide, nitrogen (or other inert gas) and air is injected into the beverage during dispensing, for example to form or assist in the formation of a head or froth on the beverage as dispensed and to ensure that the dispensed beverage may have a dissolved gas content according to consumer preference. The present invention was primarily developed for use in the dispensing of fermented beverage such as beer, lager, stout, wine and cider but may be used to advantage in the dispensing of non-fermented beverage or so-called soft drinks.

Our G. B. Patent Specification No. 1,063,753 discloses a system in which the beverage is dispensed through a supply passage under control of a valve, the beverage being derived from a bulk container. An injector is provided for introducing gas under pressure into the beverage in the supply passage remotely from the bulk container and during dispensing so that such injected gas forms or assists in the formation of fine bubbles to develop a head of foam on the dispensed beverage. The beverage in the bulk container may have gas dissolved therein and be withdrawn from that container with a headspace of that gas; alternatively the beverage in the bulk container may, for practical purposes, be considered as having no gas dissolved therein so it is substantially flat. In either event the gas which is injected into the beverage during dispensing may ensure that the beverage as dispensed will have a gas content which, for a particular beverage, is regarded as desirable in providing the flavour and head characteristics required of that beverage. Accordingly, it is desirable that the injector admits consistent predetermined quantities of the gas to the beverage being dispensed to ensure that the system, once set up for a particular beverage, will provide predetermined and constant characteristics for the beverage as dispensed. In our prior proposal the gas was introduced to the beverage by way of a needle valve and an injector nozzle—the former serving to adjust the gas pressure to the nozzle; however, experience has shown that with this arrangement the beverage as dispensed could have inconsistent characteristics, possibly resulting from an inconsistency in the flow of the gas which was introduced (perhaps due to the coarseness in the control of the needle valve and the inconsistent gas flow characteristics through that valve). Accordingly, there is still a requirement for a relatively simple and inexpensive beverage dispensing system by which one or more of an inert gas, nitrogen/air and carbon dioxide gases can be introduced into the beverage during dispensing and which alleviates the disadvantages of the prior proposals. It is an object of the present invention to satisfy this requirement.

STATEMENT OF INVENTION AND ADVANTAGES

According to the present invention there is provided a beverage dispensing system comprising valve means controlling dispensing of the beverage through a supply passage which is intended to be connected to a bulk source of the beverage, and gasifying means for introducing at least one of nitrogen (or other inert gas), carbon dioxide and air gases into said beverage in the supply passage remote from the bulk source and during dispensing of the beverage, said gasifying means having an inlet for connection to a source of the gas under pressure; a capillary restrictor through which said gas is to be directed to the supply passage and a non-return valve through which gas emanating from the restrictor is introduced to the beverage.

By "inert gas" as used throughout this Specification is meant a gas other than carbon dioxide with the following properties (i) it does not itself react chemically with the beverage;

(ii) when applied to, or dissolved in, the beverage it does not promote or develop bacteriological reactions;

(iii) it is not harmful to the consumer;

(iv) it does not impair the normal taste of the beverage. Accordingly nitrogen may be regarded as an inert gas; an example of another inert gas which may be considered suitable for the purpose of the present invention is argon.

The capillary restrictor provides a simple, inexpensive and convenient means for reducing the pressure and flow of gas which is to be introduced to the beverage whereby relatively high pressure gas from the source thereof is reduced in its flow rate to relatively small consistent quantities for introduction into the beverage by way of the non return valve. The source of gas under pressure will likely be a storage bottle, a ring main which is often available on retail premises (especially for carbon dioxide) or a compressor for air and in each case the pressure of the gas which is derived from such source should be substantially constant. Preferably, although the gas source should be at constant pressure, this pressure is adjustable for the purpose of setting up the system in accordance with the characteristics of the capillary restrictor, non return valve and the beverage flow rate to ensure that a correct proportion of gas can be introduced consistently into the beverage during dispensing to provide the required characteristics of that beverage when dispensed.

The capillary restrictor is preferably constructed in tubular form, one end of which tube communicates with the gas source and the other end of which communicates with the non-return valve.

The non-return valve is primarily intended to alleviate the back flow of beverage from the supply passage into the capillary restrictor where such beverage, when subjected to the gas flow, can dry out and obturate the capillary restrictor. The non-return valve conveniently comprises a resilient diaphragm which normally closes an aperture through which the gas is introduced into the beverage but which diaphragm is displaced under the pressure of such gas to open that aperture and admit the gas to the beverage during dispensing. Preferably the gas which is introduced to the beverage is controlled so that its introduction is effected only during such times as the beverage is being dispensed.

Preferably the supply passage immediately downstream of the position at which the gas is introduced into the beverage includes means, such as baffles or a labyrinthine mixer, by which the beverage is subjected to turbulence to promote the rate at which the introduced gas is absorbed by the beverage. The supply passage preferably also includes small apertures or restrictors through which the beverage is dispensed downstream of the position at which the gas or gases are introduced (particularly where the introduced gas is, or comprises, nitrogen), which small apertures or restrictors subject the beverage to cavitation and assist in liberating the dissolved gas from the beverage to form or assist in the formation of a froth or head on the dispensed beverage.

The gas may be introduced into the beverage in the supply passage upstream or downstream of the valve means which controls the dispensing of the beverage. Preferably such introduction is effected at a position adjacent to the valve means, the latter usually being in the form of a manually controlled dispensing tap.

For the majority of beers, lagers, stouts, wines, ciders or soft drinks which may be dispensed from a bulk container, the gas which is introduced thereto by way of the capilliary restrictor and during the dispensing operation will be carbon dioxide. However, for some fermented beverages, particularly stout, the gas which is introduced during the dispensing will be nitrogen or air (relying upon the high nitrogen content in air as discussed in our G. B. Patent Specification No. 1,063,753).

The bulk source of the beverage when coupled to the system may be in a rigid container such as a cask or keg or may be in a flexible container which collapses under atmospheric pressure as the beverage is withdrawn therefrom in accordance with the disclosure in our co-pending U.S. patent application Ser. No. 133,217 filed on Dec. 14, 1987. A pump can be provided in the supply passage for withdrawing beverage from the bulk source and preferably such pump is intended to be operated only during dispensing of the beverage.

As was previously mentioned, the bulk source of the beverage may have gas (usually carbon dioxide) dissolved therein. When the beverage emanates from a cask, keg or other rigid container and has gas dissolved therein, the headspace of the container may communicate with a source of that gas under pressure to ensure that the dissolved gas content of the beverage in the container remains substantially constant.

DRAWINGS

One embodiment of a beverage dispensing system constructed in accordance with the present invention will now be described, by way of example only, with reference to the accompanying illustrative drawings, in which:

FIG. 1 diagrammatically illustrates a typical set up of the system in a bar or other retail outlet for the beverage;

FIG. 2 is a part section of the gasifying means and control or dispensing valve incorporated in the system of FIG. 1; and FIGS. 3 and 4 respectively illustrate, in part section, modified forms of gasifying means and control or dispensing valves suitable for use in the system of FIG. 1.

DETAILED DESCRIPTION OF DRAWINGS

Figure 1:
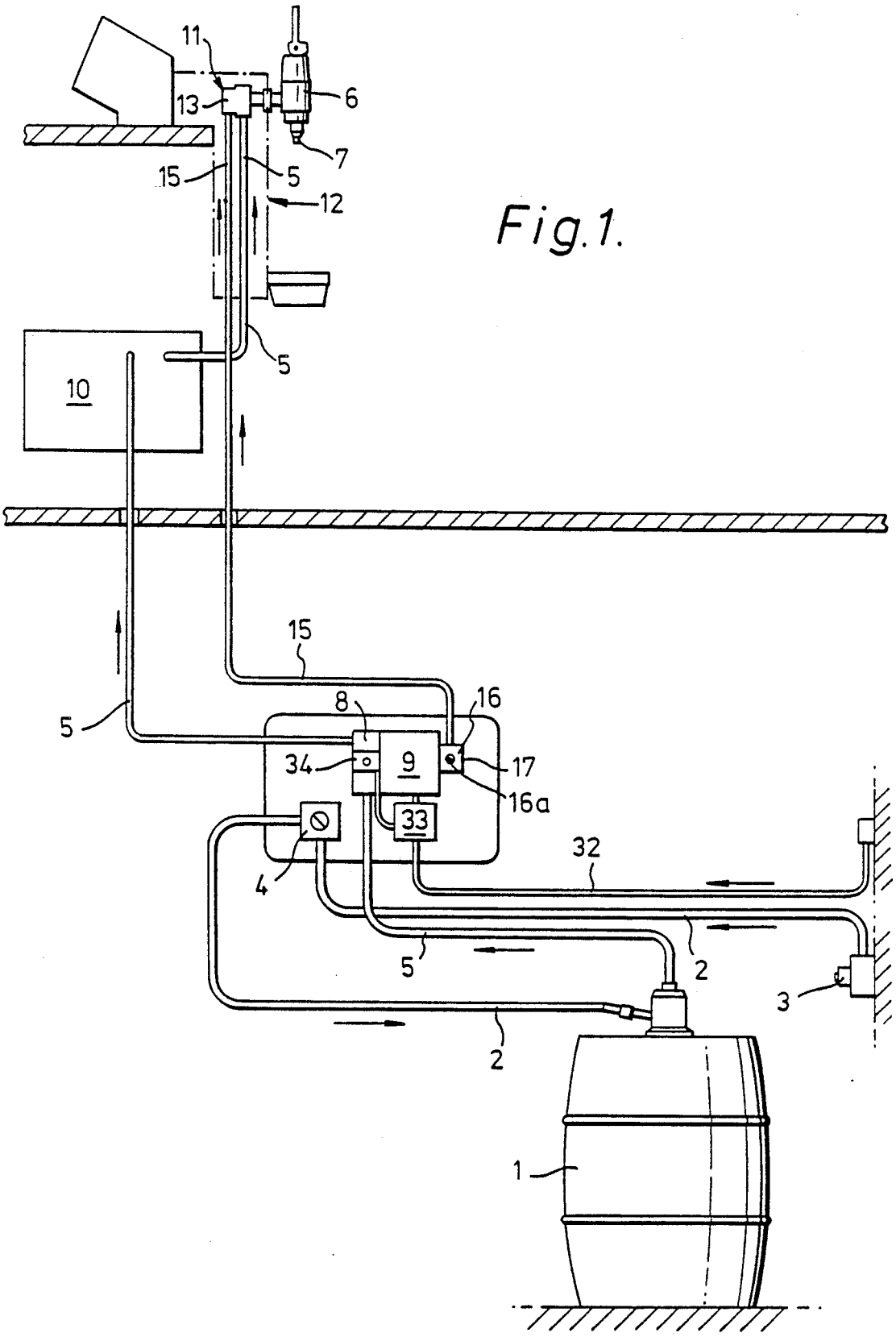

The system shown in FIG. 1 is primarily intended for dispensing stout from a cask 1. The stout within the cask has approximately one volume of carbon dioxide gas dissolved in each volume of that stout at atmospheric pressure and 15° C. To maintain the concentration of carbon dioxide in the stout as the cask is emptied the headspace of the cask communicates with a pipe 2 through which carbon dioxide under pressure is supplied from a ring main 3 on the premises. In practice the ring main 3 may supply carbon dioxide at approximately 20 lbs per square inch which is reduced in pressure at an appropriate reducer 4 in the pipe 2 to approximately 1 or 2 lbs per square inch for admission to the cask headspace.

The stout from the cask 1 is dispensed by way of a supply pipe 5 through a standard form of dispensing tap 6 having an outlet nozzle 7 and including a manually adjustable valve by which dispensing is controlled. The pipe 5 communicates with the stout in the cask through a dip tube and the stout is withdrawn by operation of a pump 8 driven by an electric motor 9. The supply pipe 5 passes through a cooler 10 by which the stout is intended to be cooled to an appropriate temperature for consumption.

Figure 2:
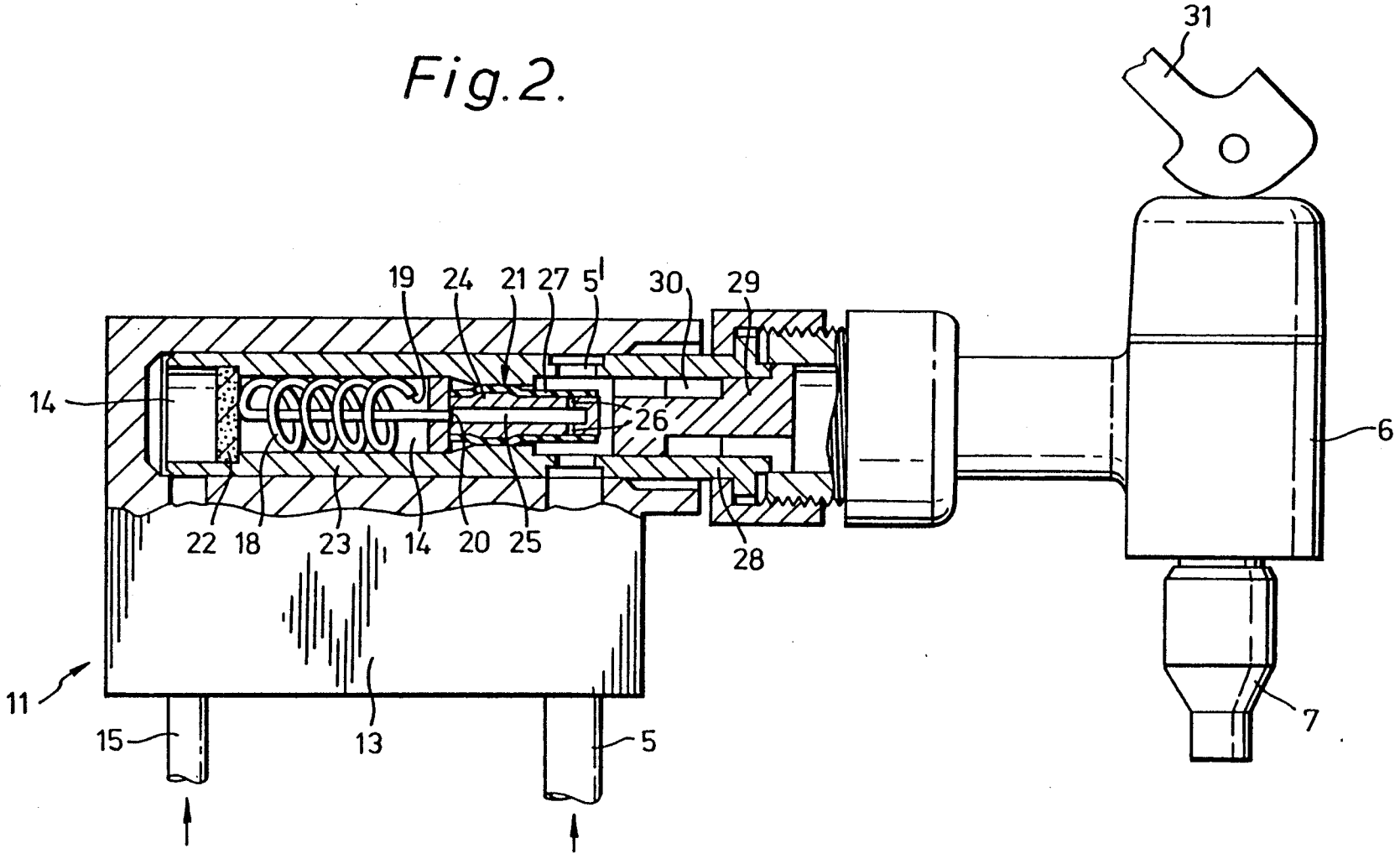

Incorporated in the supply pipe 5 is a gasifying unit indicated generally at 11 which is best seen in FIG. 2 and conveniently forms part of the mounting for the tap 6 on a bar counter unit indicated at 12.

In the present example the stout is intended to be dispensed with a dissolved gas content of carbon dioxide and nitrogen with the nitrogen gas being derived from the admission of air to the stout during its dispensation as discussed in out G. B. Patent No. 1,063,753. Usually the nitrogen gas will be admitted to the extent of approximately 0.002 to 0.1 volumes into each volume of stout which is to be dispensed, the latter being dispensed with the previously mentioned carbon dioxide content.

The gasifying unit 11 has a housing 13 within which is formed an air chamber 14 communicating with an air pipe 15. Air under pressure is introduced into chamber 14 by way of the pipe 15 from an air pump 16 having an air intake 17 and driven by the motor 9 simultaneously with the beverage pump 8. Located within the chamber 14 is a capillary restrictor tube 18 one end 19 of which tube opens to the chamber 14 and the other end 20 of which is in sealed communication with a non return valve 21. An air filter 22 is provided between the air pipe 15 and the air inlet 19 of the capillary tube. In practice, the tube is likely to have a bore in the range of approximately 0.05 to 0.4 millimetres diameter and a length in the range of approximately 25 to 1000 millimetres. The non return valve 21, capillary tube 19 and filter 22 are mounted in the housing 13 within a sleeve member 23.

The non return valve 21 is formed by a hollow spigot 24, the interior chamber 25 of which is in sealed communication with the tube end 20. The spigot 24 projects from the sleeve member 23 into the supply pipe 5 and is provided with ports 26 through which air is intended to be introduced into the stout in the pipe 5. Received on the spigot 24 is a resilient sleeve 27 of, for example, rubber which normally closes the ports 26. It will be noted that the spigot 24 is provided with an external annular localised enlargement or "belly" to retain the resilient sleeve 27 thereon. The spigot member 24 together with the sleeve 27 are received in the bore of the sleeve member 23 as a push or press fit so that the resilient sleeve 27 provides a convenient means of sealing around the exterior of the spigot member 24 and between the air chamber 14 and the beverage in the supply pipe 5. It will be apparent from the aforegoing that the structure of the non return valve 21 is similar to that of the well known conventional bicycle tire valve so that air under pressure in the interior chamber 25 can displace the sleeve 27 to open the ports 26 and admit air into the beverage in the passage 5.

Mounted on the housing 13 to continue the supply passage 5 downstream of the ports 26 is an extension tube 28 within which is located a flanged and recessed plug 29 forming a labyrinthine passage part 30 for the flow of stout through the supply passage and by which that stout is subjected to turbulence prior to flowing to the standard dispensing tap 6. The tap 6 has a conventional on/off valve which is operated by a handle 31 to control dispensing of the stout through the standard nozzle 7. Conveniently the tap 6 is removably mounted on the extension tube 28 and the latter is removably mounted on the housing 13 so that by removal of the tap it is a simple matter to replace or cleanse the plug 29 and by removal of the tubular extension 28. it is a simple matter to remove the sleeve member 23 for replacement, cleansing or servicing of the filter disc, capilliary tube and non return valve.

In use of the dispensing system the motor 9 is driven from an electrical supply 32 through a control unit 33 which is responsive to a pressure switch 34 in the pump 8. With the motor 9 running to drive both the stout pump 8 and air compressor 16 and with the dispensing tap 6 open, stout is withdrawn from the cask 1 through the supply pipe 5 (whilst the stout in the cask is maintained with a head of carbon dioxide under pressure). This stout flows into the housing 13 and therefrom by way of the labyrinthine mixer to be dispensed through the nozzle 7. Simultaneously with such flow, air under pressure in the passage 15 flows into the chamber 14, through the filter disc 22 and then by way of the capillary tube and non return valve 21 to be introduced into the stout by way of the ports 26. Consequently the mixture of stout and air is subjected to turbulence within the passage part 30 to promote the absorption of the air within the stout for dispensing purposes. The nozzle 7 may include an apertured plate (not shown) of standard form through which the stout is dispensed, such apertures in the plate subjecting the stout to cavitation and assisting in liberating the dissolved gases, particularly the nitrogen content, for promoting the development of a head or froth on the stout when dispensed into an open topped container.

Following a dispensing operation and when the tap 6 is closed, the motor 9 continues to drive the pumps 8 and 16 for a short period until the pressure of stout within the supply passage 5 between the pump 8 and tap 6 increases sufficiently to actuate the pressure switch 34 and impart a signal to the control unit 33 causing the motor 9 to be de-activated. Upon a further dispensing operation when the tap 6 is open, pressure within the supply passage 5 is relieved causing the pressure switch 34 to re-activate the motor 9 and drive the pumps 8 and 16.

It will be apparent that during a dispensing operation the air under pressure from the compressor 16 is subjected to a considerable pressure drop in flowing through the capillary restrictor tube 18 to the non return valve for admission to the stout and the capillary tube provides a convenient and inexpensive means for accurately determining the relatively small volume of air which is to be introduced into each volume of stout. Although the capillary tube alleviates the coarseness of the air flow from the compressor 16, the air compressor is adjustable at **16*a* to vary the air pressure to the pipe 15—this adjustment usually being necessary only in setting up the system for the particular characteristics of the stout and the components in the system prior to dispensing for retail purposes. It will be noted from FIG. 1** that the cask, control units, carbon dioxide supply and pumps are conveniently located in a cellar of the premises and that the electric motor pumps, control unit and carbon dioxide pressure reducer may be installed as a conveniently compact unit.

Figure 3:
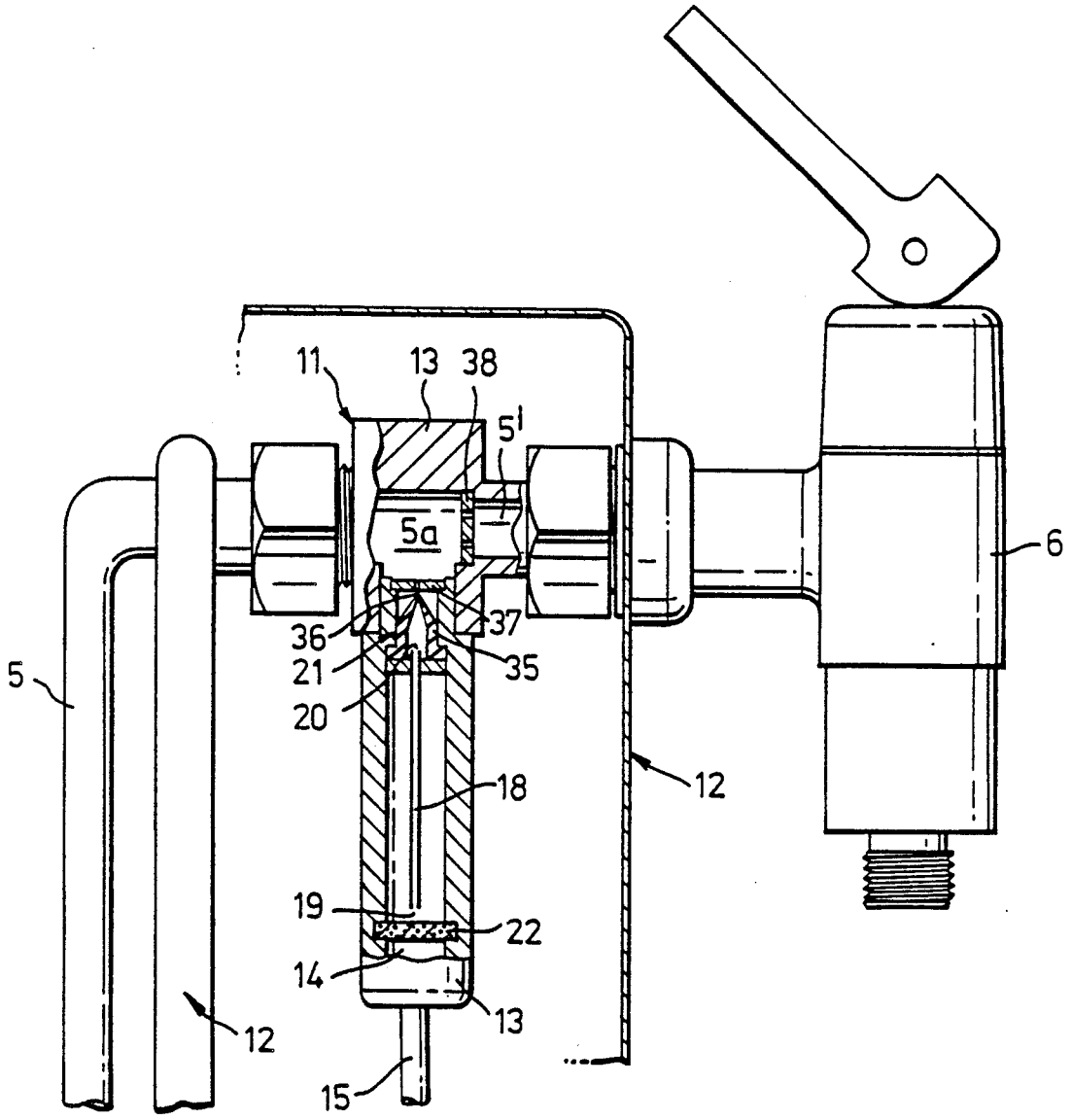

The modification shown in FIG. 3 primarily concerns the arrangement of the gasifying means 11 and the structure of the non return valve 21. In FIG. 3 the end 20 of the capilliary tube 18 is in sealed communication with the interior of a hollow resilient diaphragm 35 of conical form. The apex 36 of the diaphragm is formed as a slot-like aperture which is normally closed under the resilience of the diaphragm. This diaphragm 35 serves as a non return valve whereby air under pressure from the tube 18 can flow through the slot 36 and by way of a restrictor plate 37 into a chamber part **5*a* of the supply passage 5 for mixture with the beverage in that passage. When the air supply pressure in pipe 15 is reduced the slot 36 closes to alleviate the back flow of beverage through the plate 37** into the capillary tube.

In this modification an apertured restrictor plate 38 is provided in the supply passage 5 immediately downstream of the position at which the air is introduced to the beverage. The restrictions in the plate 38 tend to create turbulence in the passage part **5*a* to promote the absorption of the air within the beverage and also subject the beverage in passing therethrough to cavitation to promote the development of the head or froth. The location of the cavitation plate in the position 38 as shown is in addition to such a plate on the nozzle of the tap 6** as previously discussed.

It will be apparent that in both arrangements shown in FIGS. 2 and 3 the non return valve 21 alleviates the flow of beverage from the supply passage into the capillary tube and thereby the likelihood of this beverage drying out under the air stream and obturating the capillary tube.

Figure 4:
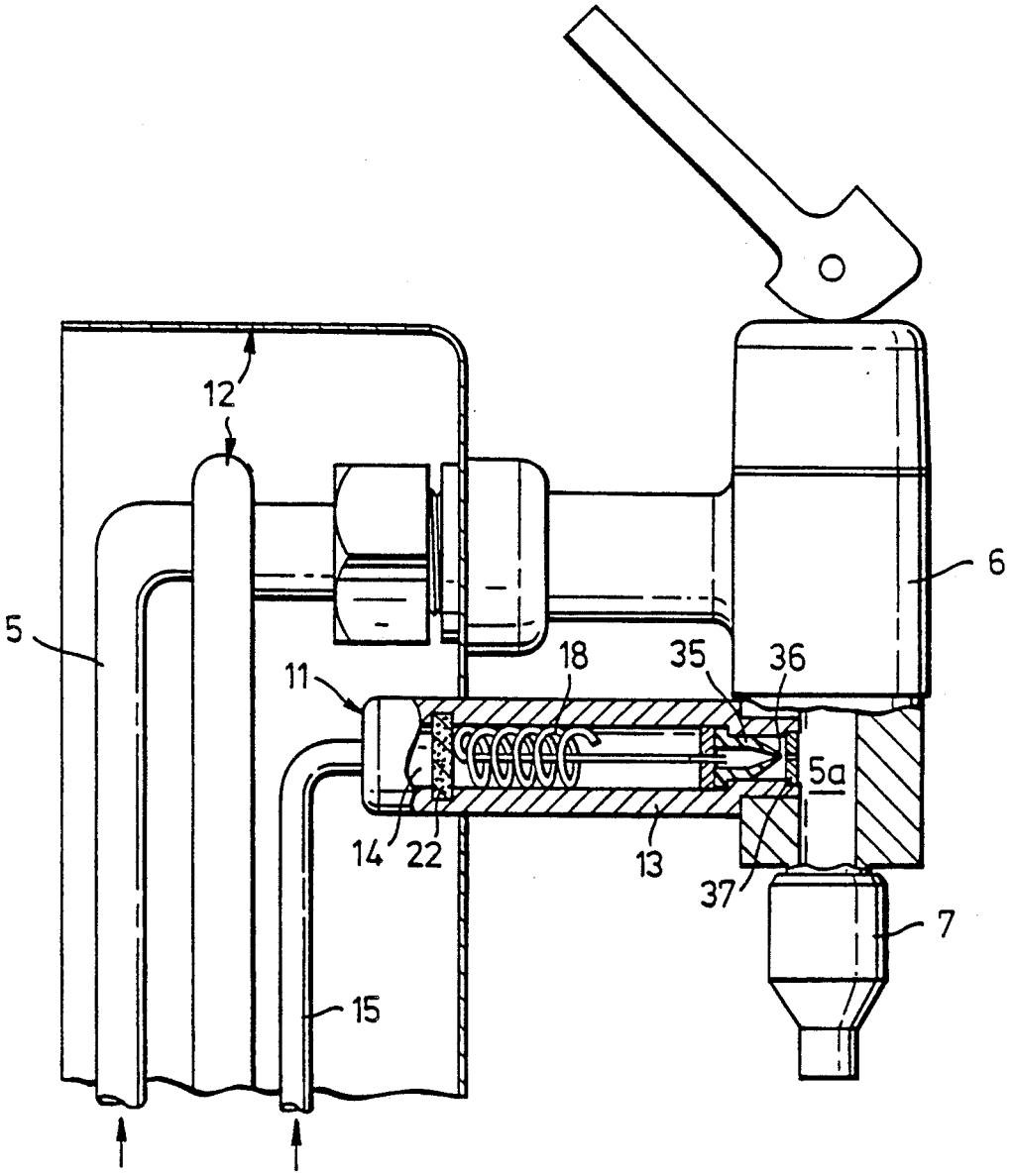

The modification shown in FIG. 4 has a similar gasifying arrangement 11 to that shown in FIG. 3 but in FIG. 4 the air is introduced at a position downstream of the on/off valve in the tap 6 and an apertured cavitation plate is conveniently located in the nozzle 7 as previously discussed.

It will be realised that if the system as above described and illustrated is to be used for the dispensing of a beverage in which, for example, carbon dioxide is to be introduced through the gasifying means 11 then the pipe 15 will be connected to an appropriate source of such gas, for example to the outlet from the pressure reducing valve 4. Also it may not be essential for all beverage containers to be provided with a carbon dioxide headspace, for example if the cask 1 is replaced by a flexible container which is intended to collapse under atmospheric pressure as the beverage is withdrawn to maintain such beverage substantially without headspace in the manner discussed in our co-pending U.S. Patent Application Ser. No. 133,217 filed on Dec. 14, 1987 now abandoned.

We claim:

1. A beverage dispensing system comprising valve means controlling dispensing of the beverage through a supply passage which is intended to be connected to a bulk source of the beverage, and gasifying means for introducing at least one of nitrogen, carbon dioxide, and air gases into said beverage in the supply passage remote from the bulk source and during dispensing of the beverage, said gasifying means having an inlet for connection to a source of the gas under pressure; a capillary restrictor through which said gas is to be directed to the supply passage, said restrictor having a bore in the range of 0.05 to 0.4 millimeters diameter and a length in the range of approximately 25 to 1,000 millimeters, means for adjusting the pressure of the gas supplied to the capillary restrictor, and a non-return valve through which gas emanating from the restrictor is introduced to the beverage.

2. A system as claimed in claim 1 in which the supply passage downstream of the position at which the gas is introduced has means for subjecting the beverage to turbulence to promote the rate at which the introduced gas is absorbed by the beverage.

3. A system as claimed in claim 2 in which the means for subjecting the beverage to turbulence comprises a labyrinthine mixer in the supply passage.

4. A system as claimed in claim 1 in which the supply passage has small apertures or restrictors through which the beverage is dispensed downstream of the position at which the gas is introduced, said apertures or restrictors assisting in the liberation of the dissolved gas from the beverage for the formation of a head or froth.

5. A system as claimed in claim 1 in which the gasifying means is located to introduce the gas at a position in the supply passage upstream of the valve means.

6. A system as claimed in claim 1 in which the supply passage communicates with a bulk source of the beverage in a rigid container.

7. A system as claimed in claim 6 in which the beverage in the container has carbon dioxide dissolved therein.

8. A system as claimed in claim 7 in which the container communicates with a source of carbon dioxide under pressure which maintains carbon dioxide at a predetermined pressure in the headspace of that container.

9. A system as claimed in claim 1 in which a pump is provided for supplying the beverage through the supply passage on demand.

10. A system as claimed in claim 9 in which an air compressor is provided from which air under pressure is supplied on demand to the beverage.

11. A system as claimed in claim 10 in which the pump and air compressor are driven simultaneously from a common motor which motor is actuated when demanded for dispensing of the beverage.

12. A system as claimed in claim 9 in which the pump and air compressor are driven simultaneously from a common motor which motor is actuated when demanded for dispensing of the beverage.

13. A system as claimed in claim 1 in which the capillary restrictor is of tubular form one end of which tube communicates with said inlet and the other end of which is in sealed communication with the non-return valve.

14. A system as claimed in claim 1 in which a filter is provided through which the gas flows to the capillary restrictor.

15. A system as claimed in claim 1 in which the non-return valve comprises a resilient diaphragm which normally closes an aperture through which the gas is introduced in the beverage and which diaphragm is displaced under the pressure of such gas to open said aperture and admit the gas to the beverage during dispensing.

16. A system as claimed in claim 15 in which the nonreturn valve comprises a hollow member into which the gas is directed from the capillary restrictor, said hollow member having a port through which the gas is to flow from the interior thereof into the beverage, and wherein the resilient diaphragm is of sleeve form mounted on the hollow member to normally close said port.

17. A system as claimed in claim 1 in which the capillary restrictor and non-return valve are carried in a housing to be readily removable from the system for servicing or replacement.

18. A system as claimed in claim 1 and comprising a bulk source of fermented beverage selected from beer, lager, stout, wine and cider.

19. A system as claimed in claim 1 in which the beverage in the container has carbon dioxide dissolved therein.

* * * * *